US009243521B2

(12) United States Patent
Cornett et al.

(10) Patent No.: US 9,243,521 B2
(45) Date of Patent: Jan. 26, 2016

(54) PUMP ACTUATOR ANTI-ROTATION DEVICE

(75) Inventors: Doug R. Cornett, Hurdle Mills, NC (US); John Page Chapman, Richland, MI (US); Gary Lynn Janowiak, Saginaw, MI (US); Daniel A. Nelson, Kalamazoo, MI (US); Mark E. Jacobs, Roxboro, NC (US); Brent L. Rehm, Nashville, MI (US); Pratap S. Murthy, Ann Arbor, MI (US); Anthony Leon Spoor, Union City, MI (US); James Roy Sheren, Grand Ledge, MI (US)

(73) Assignee: Eaton Corporation, Cleveland, OH (US)

( * ) Notice: Subject to any disclaimer, the term of this patent is extended or adjusted under 35 U.S.C. 154(b) by 1078 days.

(21) Appl. No.: 13/324,804

(22) Filed: Dec. 13, 2011

(65) Prior Publication Data

US 2012/0152187 A1 Jun. 21, 2012

Related U.S. Application Data

(60) Provisional application No. 61/422,325, filed on Dec. 13, 2010.

(51) Int. Cl.
*F16J 1/10* (2006.01)
*F01L 1/14* (2006.01)

(52) U.S. Cl.
CPC . *F01L 1/14* (2013.01); *F01L 1/143* (2013.01); *F01L 2107/00* (2013.01); *Y10T 29/49304* (2015.01)

(58) Field of Classification Search
CPC ..... F01L 1/14; F01L 1/143; F01L 2107/00; F04B 9/042; F16J 1/10
USPC ..... 92/129; 123/90.5; 29/888.43
See application file for complete search history.

(56) References Cited

U.S. PATENT DOCUMENTS

| | | | |
|---|---|---|---|
| 4,747,376 | A | 5/1988 | Speil et al. |
| 5,975,038 | A | 11/1999 | Fischer et al. |
| 6,032,631 | A | 3/2000 | Haas et al. |
| 6,164,255 | A | 12/2000 | Maas et al. |
| 6,247,433 | B1 | 6/2001 | Faria et al. |
| 6,345,596 | B1 | 2/2002 | Kuhl |

(Continued)

FOREIGN PATENT DOCUMENTS

| | | | |
|---|---|---|---|
| DE | 19548808 | A | 7/1997 |
| DE | 19600852 | | 7/1997 |

(Continued)

OTHER PUBLICATIONS

International Search Report and Written Opinion for International Application No. PCT/US2011/064693 dated Apr. 20, 2012.

*Primary Examiner* — Michael Leslie
(74) *Attorney, Agent, or Firm* — Remarck Law Group PLC

(57) ABSTRACT

A tappet having a contiguous body, an outer wall and transverse web. The outer wall defines a cylindrically-shaped outer surface and a recess. The recess is disposed within cylindrical surface of the body. An alignment member is press-fit between two staked ends of the recess, which engage opposite sides of the alignment member. The alignment member extends outwardly from the cylindrically-shaped surface. A roller is mounted to the contiguous body at the cam contacting end of the tappet.

24 Claims, 11 Drawing Sheets

(56) References Cited

U.S. PATENT DOCUMENTS

| | | | |
|---|---|---|---|
| 6,659,052 | B2 | 12/2003 | Kuhl |
| 6,805,085 | B2 | 10/2004 | Kuhl et al. |
| 6,880,507 | B2 | 4/2005 | Kuhl et al. |
| 6,953,016 | B2 | 10/2005 | Karbstein et al. |
| 6,988,474 | B2 | 1/2006 | Itoafa |
| 7,055,479 | B2 | 6/2006 | Sailer et al. |
| 7,096,837 | B2 | 8/2006 | Kieninger et al. |
| 7,146,952 | B2 | 12/2006 | Kreil et al. |
| 7,159,552 | B2 | 1/2007 | Backert et al. |
| 7,210,437 | B2 | 5/2007 | Geyer |
| 7,246,584 | B2 | 7/2007 | Geiger et al. |
| 7,246,587 | B2 | 7/2007 | Evans et al. |
| 7,299,777 | B2 | 11/2007 | Meisborn et al. |
| 7,322,328 | B2 | 1/2008 | Haefner |
| 7,389,757 | B2 | 6/2008 | Itoafa et al. |
| 7,610,886 | B2 | 11/2009 | von Schimonsky |
| 7,793,583 | B2 | 9/2010 | Radinger et al. |
| 7,793,630 | B2 | 9/2010 | Shewell |
| D701,243 | S * | 3/2014 | Cornett et al. ..... D15/7 |
| 2008/0190237 | A1 | 8/2008 | Radinger et al. |
| 2009/0031977 | A1 | 2/2009 | Bugescu et al. |
| 2010/0012065 | A1 | 1/2010 | Dorn et al. |
| 2010/0229812 | A1 | 9/2010 | Dorn et al. |
| 2010/0294219 | A1 | 11/2010 | Prokop |
| 2011/0265752 | A1 | 11/2011 | Dorn et al. |

FOREIGN PATENT DOCUMENTS

| | | | |
|---|---|---|---|
| DE | 102005047234 | A | 4/2007 |
| DE | 102006057246 | A | 6/2008 |
| DE | 102007006320 | A | 8/2008 |
| DE | 102007016739 | | 10/2008 |
| DE | 102008059004 | A | 5/2010 |
| DE | 102009013130 | A | 9/2010 |
| DE | 102009013131 | A | 9/2010 |

* cited by examiner

PUMP ACTUATOR ANTI-ROTATION DEVICE

PRIORITY

This disclosure claims priority to U.S. Provisional Patent Application No. 61/422,325, filed Dec. 13, 2010, which is hereby incorporated by reference in its entirety as if fully set forth herein.

FIELD

The present teachings are directed to pump actuators and more specifically to anti-rotation devices for tappets such as fuel pump actuators.

BACKGROUND

Tappets, such as fuel pump actuators, provide a mechanism to translate rotational motion of a rotating mechanism such as a cam into linear motion. Relatively efficient translation of energy from rotational motion of rotating mechanism to linear motion of the tappet typically requires specific alignment of the tappet relative to the rotating mechanism.

SUMMARY

The present teachings generally include a pump actuator tappet having a contiguous body including an outer wall and transverse web. The outer wall defines a cylindrically-shaped outer surface and a recess. The recess is disposed within the cylindrical surface of the body. An alignment member is press-fit between two staked ends of the recess, which engage opposite sides of the alignment member. When in place, the alignment member extends outwardly from the cylindrically-shaped surface. A roller is mounted to the contiguous body at the cam contacting end of the tappet.

In a further aspect of the present teachings, a tappet has a contiguous body having a first end, a second end and an outer wall defining a first cylindrically-shaped outer surface. The contiguous body also defines an alignment portion that extends radially outward from the first outer surface. The alignment portion has a cylindrically shaped wall that is aligned with the direction of travel of the roller tappet.

BRIEF DESCRIPTION OF THE DRAWINGS

In the accompanying drawings, structures are illustrated that, together with the detailed description provided below, describe exemplary aspects and features of a tappet having an anti-rotation device. One skilled in the art will appreciate that a single component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1:
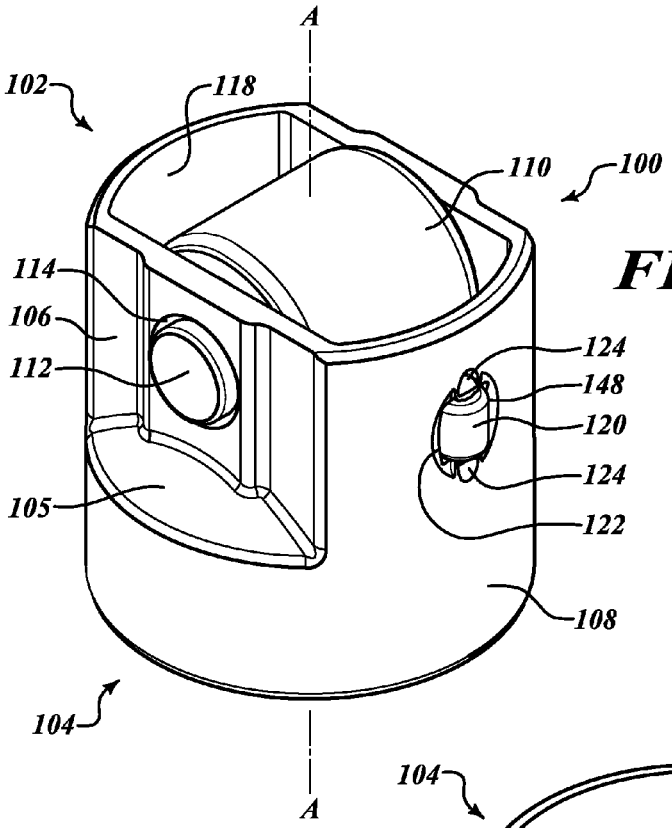
FIG. 1 illustrates a perspective view of a tappet 100 having an alignment member 120 in accordance with the present teachings.
Figure 2:
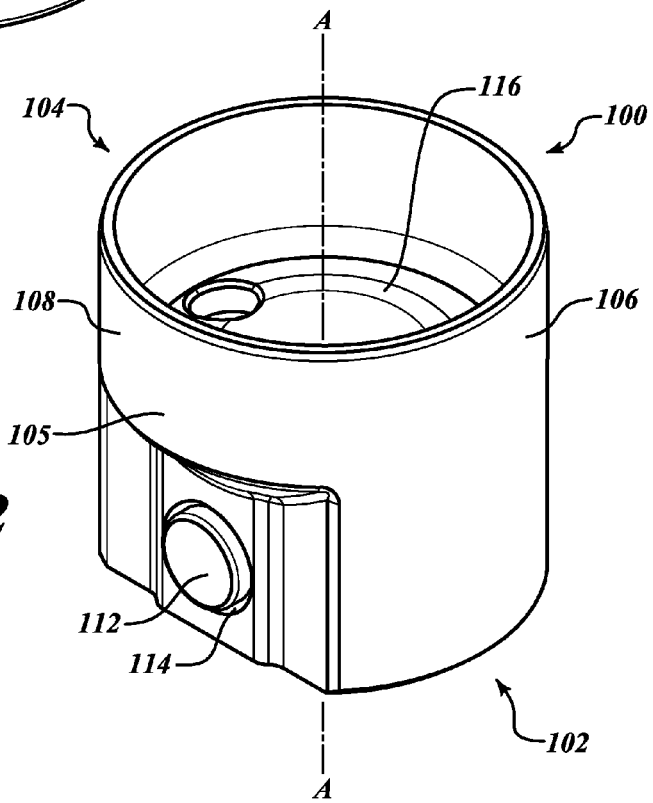
FIG. 2 illustrates an alternative perspective view of the tappet 100 shown in FIG. 1.

FIGS. 1 and 2 illustrate perspective views of a tappet 100 in accordance with the many aspects of the present teachings. The tappet 100 can have a first end 102 and a second end 104. A body 106 of the tappet 100 can define an outer wall 105 having a cylindrical outer surface 108. The cylindrical outer surface 108 can be centered about a central axis A (FIGS. 1, 2, 4, 12 and 13). As used herein, the terms "longitude," "longitudinal" or similar terms can refer to a direction parallel to A. The terms "radial," "radially" or similar terms can refer to a direction along a line perpendicular to axis A. Terms "outward," "outwardly" or similar terms can refer to directions away from the axis A, while the terms "inward" and "inwardly" can refer to directions toward the axis A. As the relative directional terms "inner" and "outer" are used herein, an "inner" element can be spaced closer to the central axis A than the "outer" element.

Figure 5:
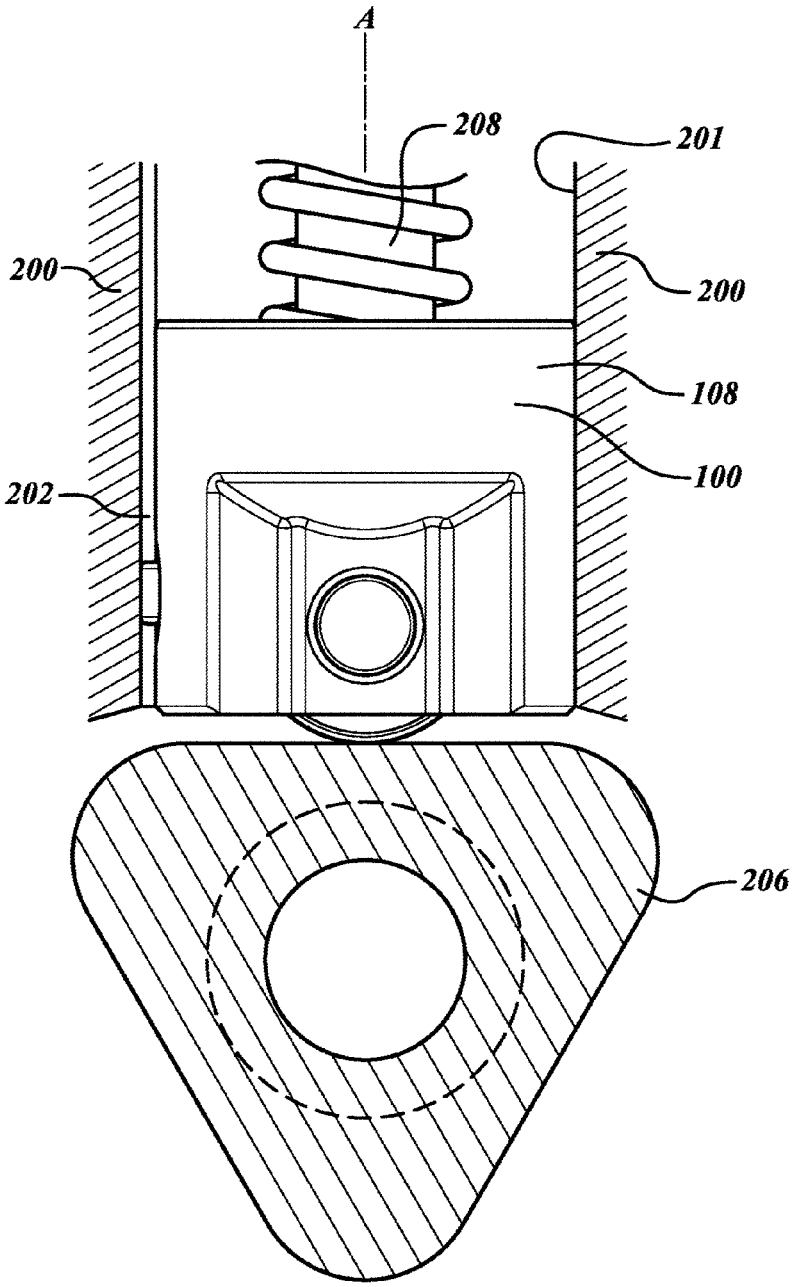
FIG. 5 illustrates a side view of tappet 100 shown in FIG. 1 within a fuel pump housing 200 in accordance with a further aspect of the present teachings.

A roller 110 can be mounted to a body 106 at a first end 102 through an axle 112 that can sit within axle holes 114. During operation, the first end 102 of the tappet 100 can make contact with a rotating cam 206, for example as shown in FIG. 5, which can cause the tappet 100 to move periodically along the longitudinal direction. The tappet 100 can take other forms at the cam-contacting first end 102. For example, in lieu of a roller 110, the tappet 100 can be constructed with a cam-contacting surface like that of a non-roller tappet. A web 116 can extend transversely relative to axis A, and can form part of a roller pocket 118.

An alignment member 120 can be press-fit into a recess 122. The alignment member 120 can be a cylindrical pin that can extend outwardly from the cylindrical outer surface 108. The alignment member 120 can be secured between two staked portions 124 of body 106. These staked portions 124 can form alignment member securing surfaces 130, 132 that can protrude into recess 122 and that can secure the alignment member 120 in place. The indentations forming the staked portions 124 can be formed into the body 106 before or after insertion of alignment member 120 into recess 122.

Figure 3:
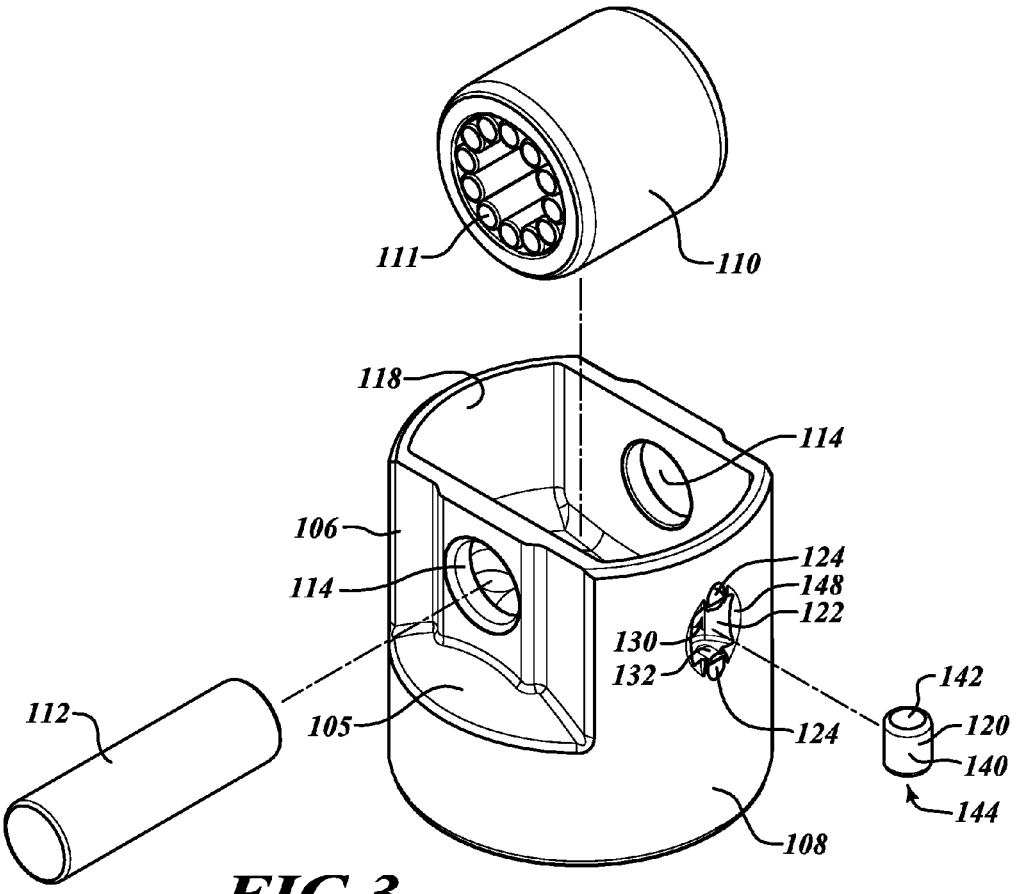
FIG. 3 illustrates an exploded view of a tappet 100 in accordance with another aspect of the present teachings.

With reference to FIG. 3, the tappet 100 includes roller bearings 111 on which roller 110 can be mounted to the axle 112 and the body 106. When assembled, the roller bearings 111 can be positioned in the roller pocket 118 and can surround the axle 112 to permit low friction rotation of the roller 110 about the axle 112. The axle 112 can be inserted through axle holes 114 and a subassembly including the roller 110 and the axle bearings 111 while such a subassembly is positioned in the pocket 118.

Figure 4:
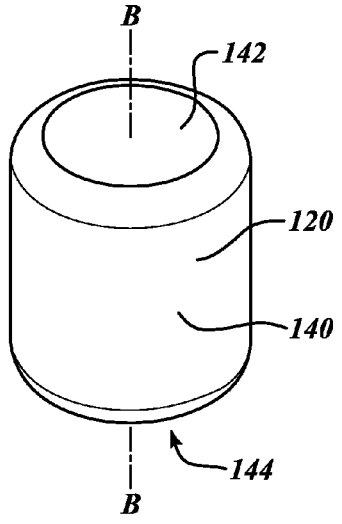
FIG. 4 illustrates a close-up view of a cylindrical alignment member 120 shown in FIG. 3.

With reference to FIG. 4, the alignment member 120 can have a cylindrical shape that can be defined by a surface 140. A first end 142 and a second end 144 of the alignment member 120 can be substantially flat and can be oriented perpendicular to axis B, which is the center axis of the cylindrical alignment member 120. Both the ends 140, 144 can be circular in shape. When assembled, the alignment member 120 is can be press-fit within a recess 122 between alignment member securing surfaces 130, 132. As described further in connection with FIG. 8, the alignment member securing surfaces 130, 132 can have protrusions that can extend into the recess 122. The recess 122 can be formed in the body 106 adjacent to the alignment member securing surfaces 130, 132. In one example, the recess 122 can be formed by staking the body 106. Once assembled, the alignment member 120 can extend outwardly from the cylindrical surface 108 of the tappet 100 and interrupt its cylindrical outer contour. It will be appreciated it light of the disclosure that the tappets in accordance with the present teachings include ornamental features aside from and in addition to the functional aspects described herein.

In one aspect of the present teachings, the body 106 of the tappet 100 can be formed from a contiguous piece of material (i.e., a single piece of material) and is manufactured by a forming process, such as cold-forming. In another aspect of the present teachings, the body 106 can be a contiguous piece of metal made from a slug of forgeable material that can be formed and subsequently heat-treated or machined or both. Examples of such forgeable metals may include but are not limited to Society of Automotive Engineers ("SAE") 1522 grade, 1018 grade, 1008-1010 grade, 8124 grade and 5120 grade steel.

With reference to FIG. 5, the tappet 100 can be included with a fuel pump housing 200. The outer cylindrical surface 108 of the tappet 100 can be configured to interface with a guide bore 201 of a fuel pump housing 200. The guide bore 201 can have a complementary cylindrical shape relative to the outer cylindrical surface 108. The alignment member 120 can ride in a slot 202. The slot 202 can be sized to allow only relatively small amounts of rotational motion of the tappet about its longitudinal axis A relative to its longitudinal motion. Rotation of a cam 206 can cause the tappet 100 to transfer linear motion to a piston 208.

Figure 6:
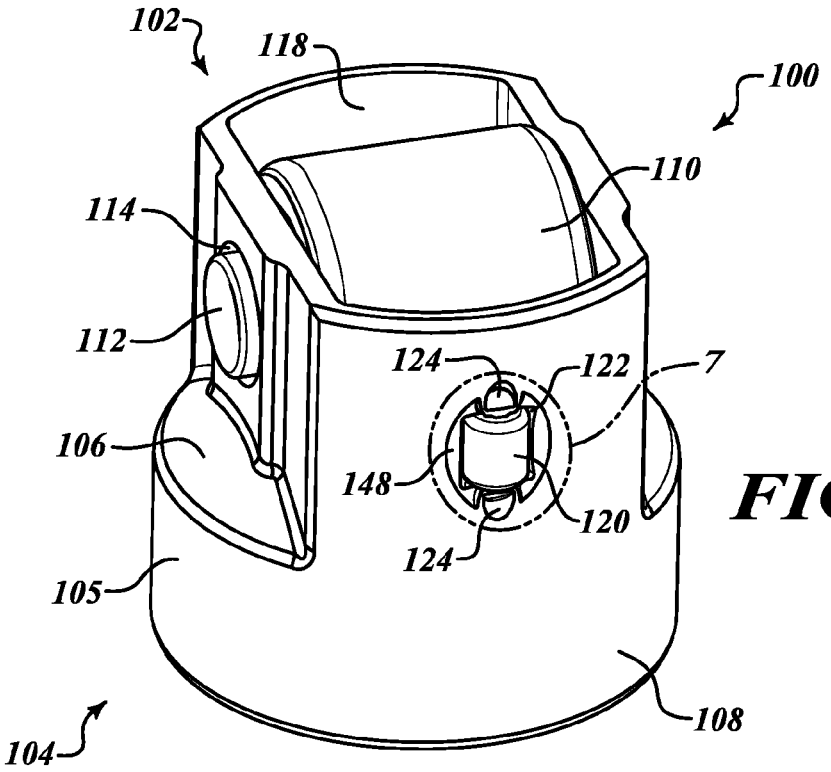
FIG. 6 illustrates an alternative perspective view of the tappet 100 shown in FIG. 1.
Figure 7:
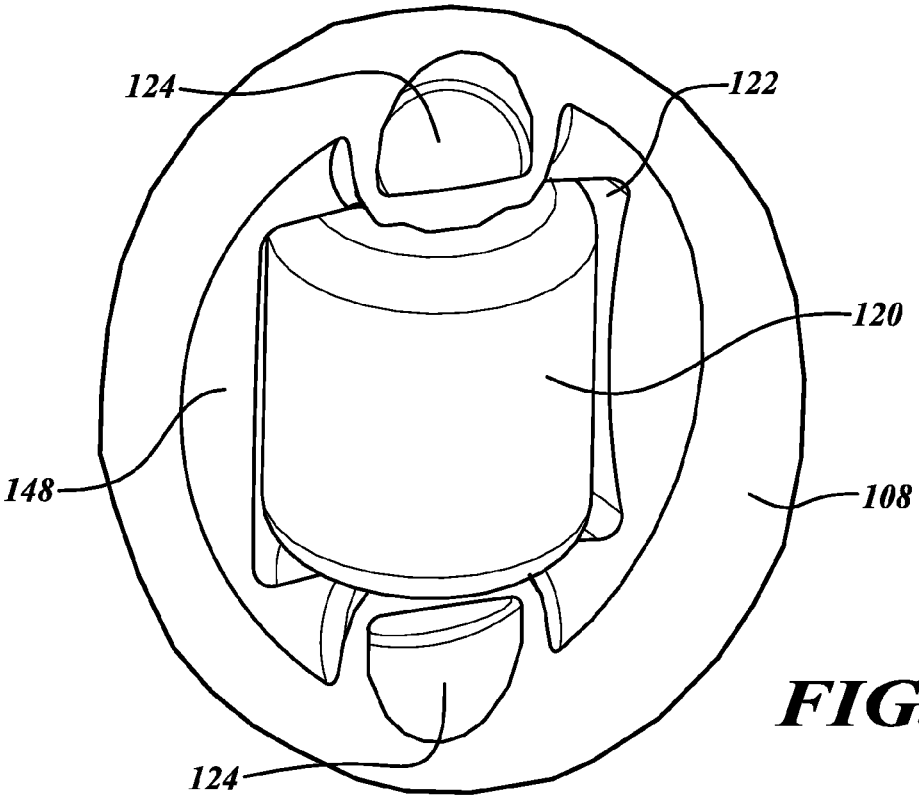
FIG. 7 illustrates a close-up view of an alignment member 120 on the tappet 100.

As shown in FIGS. 6 and 7, a concave curved surface 148 can partially surround the recess 122. The concave curved surface 148 can prevent any sharp corners from forming between the cylindrical outer surface 108 and the recess 122. The existence of sharp corners can be shown to possibly interfere with proper operation of tappet 100. The concave curved surface 148 can also be shown to assist in the formation of the staked portions 124 of the body 106 by removing additional material adjacent to the staked portions 124 that otherwise can be distorted during the process used to form the staked portions 124. Removal of such materials prevents material from extending outwardly from cylindrical surface 108 and potentially obstructing the tappet's 100 motion.

Figure 8:
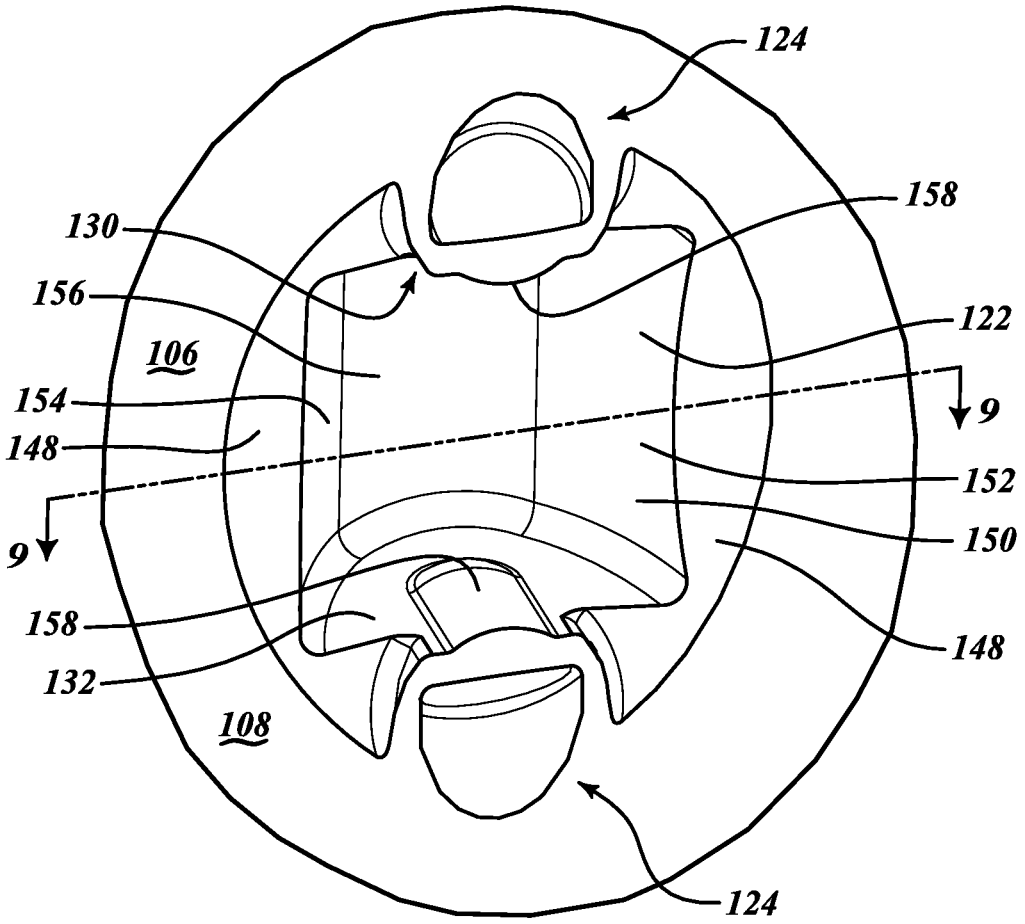
FIG. 8 illustrates a close-up perspective view of a recess 122 in the tappet 100 of FIG. 1.

With reference to FIG. 8, a body 106 of a tappet 100 has a cylindrical surface 108 that can defines a recess 122 disposed within the cylindrical surface 108 of the body 106 of a tappet 100. The recess 122 can have a recess surface 150 that can include a first curved surface 152, a second curved surface 154, and an intermediate surface 156. In one aspect of the present teachings, each of the curved surfaces 152, 154 and intermediate surface 156 can be cylindrically-shaped surfaces, the central axes of which can be parallel to axis A, coinciding with the direction of travel of tappet 100. A first alignment member securing surface 130 can be disposed at the end of recess 122 proximal to a cam contacting end 102 of the tappet 100, while the second alignment member securing surface 132 is disposed at the end of recess 122 distal to the cam contacting end 102 of the tappet 100. The alignment member securing surfaces 130, 132 can be configured to receive a cylindrical alignment member 120. In one example, the alignment member securing surfaces 130, 132 can be configured to receive the cylindrical alignment member 120, as shown in FIG. 4. One or both of the alignment member securing surface 130, 132 can have a protruding surface 158 that can extend into the recess 122. The protruding surfaces 158 are a result of the staking process that can form the staked portions 124. The staked portions 124 therefore can be adjacent alignment member securing surfaces 130, 132 and in particular adjacent the protruding surfaces 158. The alignment member securing surfaces 130, 132 can engage the ends of an alignment member 120 in a press-fit relationship and thereby can secure the alignment member 120 in the recess 122. In this arrangement, the concave curved surface 148 can partially surround the recess 122.

Figure 9:
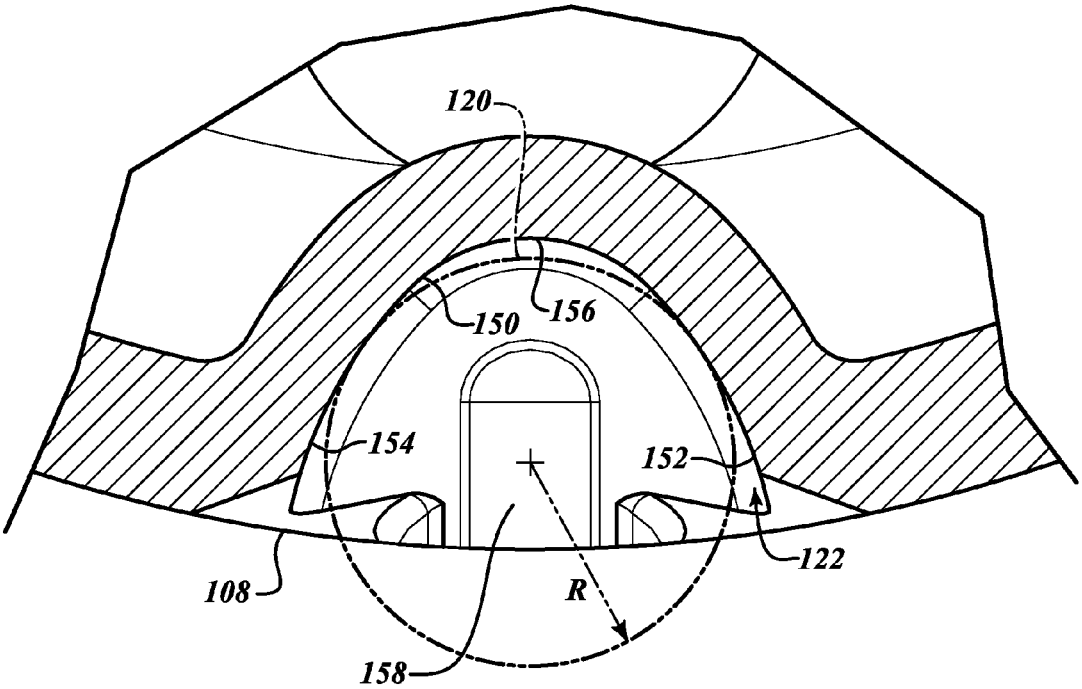
FIG. 9 illustrates a sectional view of a recess 122 along the line 9-9 shown in FIG. 8.

With reference to FIG. 9, the alignment member 120 can be in the form of a cylindrical pin having radius R (shown with phantom lines). In one aspect of the present teachings, more than half of the volume of the alignment member 120 can be disposed within the recess 122, and in particular, more than half of the volume of the alignment member 120 can be disposed radially inward relative to the cylindrical outer surface 108. The recess surface 150 can be formed from three cylindrical curved surfaces: a first alignment member contacting surface 152, a second alignment member contacting surface 154, and an intermediate surface 156. The alignment member contacting surfaces 152, 154 can have a cylindrical shape with central axes aligned with the axis A. The radius of both alignment member contacting surfaces 152, 154 can be greater than the radius R of the cylindrical alignment member 120. The alignment member contacting surfaces 152, 154 can also cooperate to limit the depth at which the alignment member 120 can be inserted. For example, the alignment member 120 can make contact with one or both alignment member contacting surfaces 152, 154 as the alignment member 120 is inserted during manufacture, or during operation when the alignment member 120 can encounter contact forces with an internal surface of a fuel pump housing 200. The alignment member contacting surfaces 152, 154 can prevent the alignment member 120 from receding further into the recess 122 by providing support to the alignment member 120 when in contact with the alignment member 120. The support to the alignment member 120 can be shown to be from a normal force applied to the alignment member 120 at the point of contact between the alignment member 120 and one or both of the alignment member contacting surfaces 152, 154. The normal force applied by either one of the alignment member contacting surfaces 152, 154 can be oriented to point at an oblique angle relative to the radial direction ρ at the point or points of contact between the alignment member 120 and member contacting surfaces 152, 154.

The intermediate surface 156 can join the alignment member contacting surfaces 152, 154. In one aspect of the present teachings, the intermediate surface 156 is a cylindrical surface with an axis aligned with the axis A. The radius of curvature of the intermediate surface 156 can be less than the radius R of the alignment member 120. In alternative aspects of the present teachings, the intermediate surface 156 can have a radius of curvature equal to or less than the radius of curvature of the cylindrical alignment member 120. The intermediate surface 156 need not be cylindrical, but can be implemented with other curved or angular forms including planar and curved surfaces. In another aspect of the present teachings, the intermediate surface 156 does not contact the alignment member 120.

Figure 10:
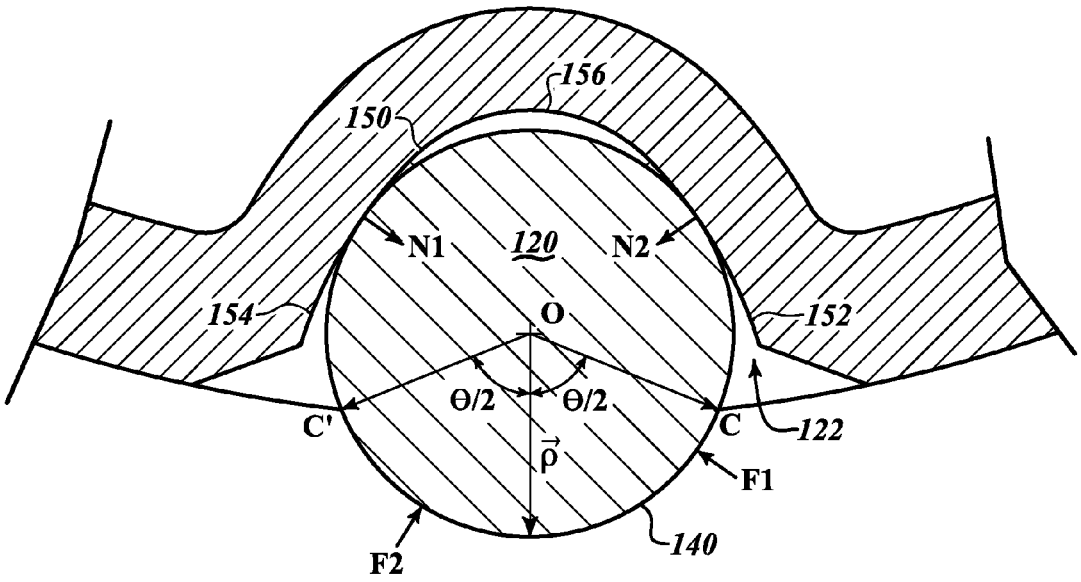
FIG. 10 illustrates a free-body diagram of alignment member 120 in recess 122.

FIG. 10 illustrates a free-body diagram of the alignment member 120. Vectors N1 and N2 represent the directions from which the curved surfaces 152, 154 of the recess surface 150 can apply force on the alignment member 120. The forces along vectors N1 and N2 are contact forces applied by the curved surfaces 152, 154 at their points of contact with the alignment member 120 and are normal to the surface 140 of the alignment member 120. These normal vectors N1 and N2 are oblique with respect to the radial direction ρ. F1 and F2 represent examples of directions in which forces may be applied against the alignment member 120 by the fuel pump housing 200 and in particular the slot 202 shown in FIG. 5. During operation within such a pump housing 200, external forces may be applied to the alignment member 120 along any vector within the range theta, which spans the angular region between ray OC and ray OC'. This angular range corresponds to the range of locations on the alignment member surface 140 that can come into contact with the pump housing 200.

In an example where a force is applied at the alignment member surface 140 along vector F1, which is opposite in direction to normal vector N1, and the force along F2 is zero, the curved surface 154 can apply a sufficient normal force along N1 to cancel the force along F1. Under such circumstances, no outwardly directed forces are applied to the alignment member 120, and in particular, no forces are applied to the alignment member 120 tending to dissociate the alignment member 120 from the recess 122. In another example where no force is applied along vector F1, and a force is applied at the alignment member surface 140 along vector F2, which is more aligned with the radial direction p than vector F1, the curved surfaces 152, 154 can collectively apply forces in the directions N1 and N2 sufficient to cancel the force in the direction of F2 on the alignment member surface 140, resulting in no net outward force on the alignment member 120, and in particular, no forces are applied to the alignment member 120 in this example tending to dissociate the alignment member 120 from the recess 122. In one aspect of the present teachings, force applied to the alignment member surface 140 at any point within the middle 90% of the range θ results in no outwardly directed force on the alignment member 120 tending to dissociate the alignment member 120 from recess 122. In another aspect of the present teachings, force applied to the alignment member surface 140 at any point within the range θ results in no outwardly directed force on the alignment member 120 tending to dissociate the alignment member 120 from recess 122.

Figure 11:
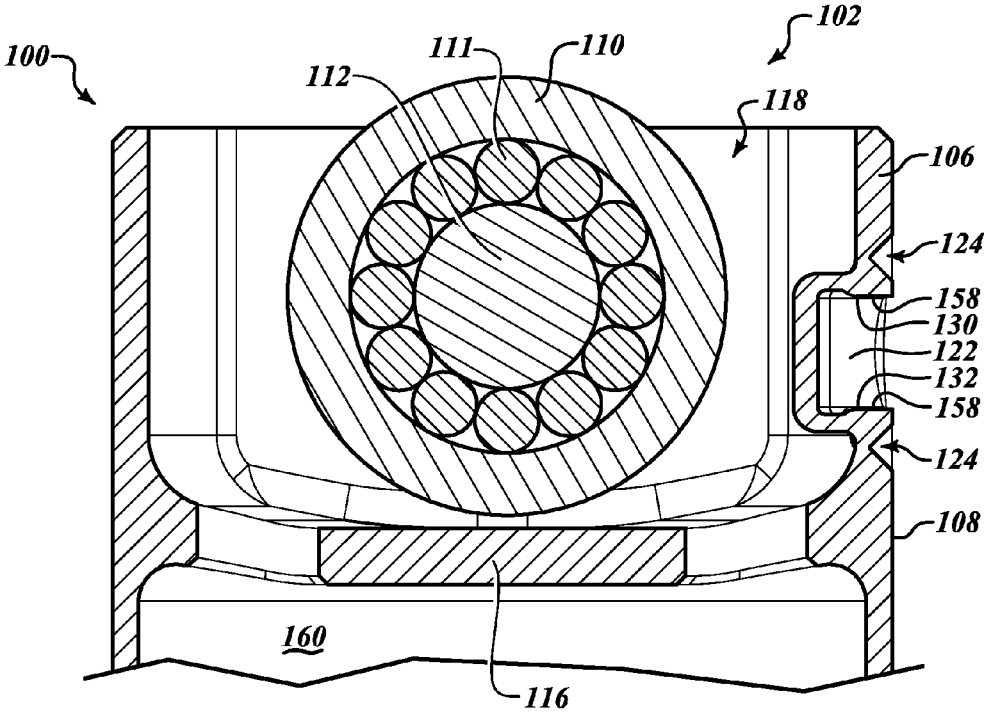
FIG. 11 illustrates a partial cross-sectional side view of a roller tappet 100.

With reference to FIG. 11, the alignment member securing surfaces 130, 132 can be disposed at opposite longitudinal ends of recess 122, with the first alignment member securing surface 130 disposed proximate to the cam contacting end 102 of tappet 100, and the second alignment member securing surface 132 disposed distal to the cam contacting end 102. The protruding surfaces 158 that form part of both alignment member securing surfaces 130, 132 can be formed within the recess 122 and adjacent to staked portions 124 of body 106. In a further aspect of the present teachings, the staked portions of body 106 do not extend past the outer cylindrical surface 108.

With continued reference to FIG. 11, a roller pocket 118 can be formed, in part, by a transverse web 116, which can separate pocket 118 from the cup-shaped portion 160. In one aspect of the present teachings, the cup-shaped portion 160 can receive an end of a piston 208. In another aspect of the present teachings, the recess 122 can be longitudinally offset from both the cam contacting end 102 and the transverse web 116, and can be located between the cam contacting end 102 the and the transverse web 116.

Figure 12:
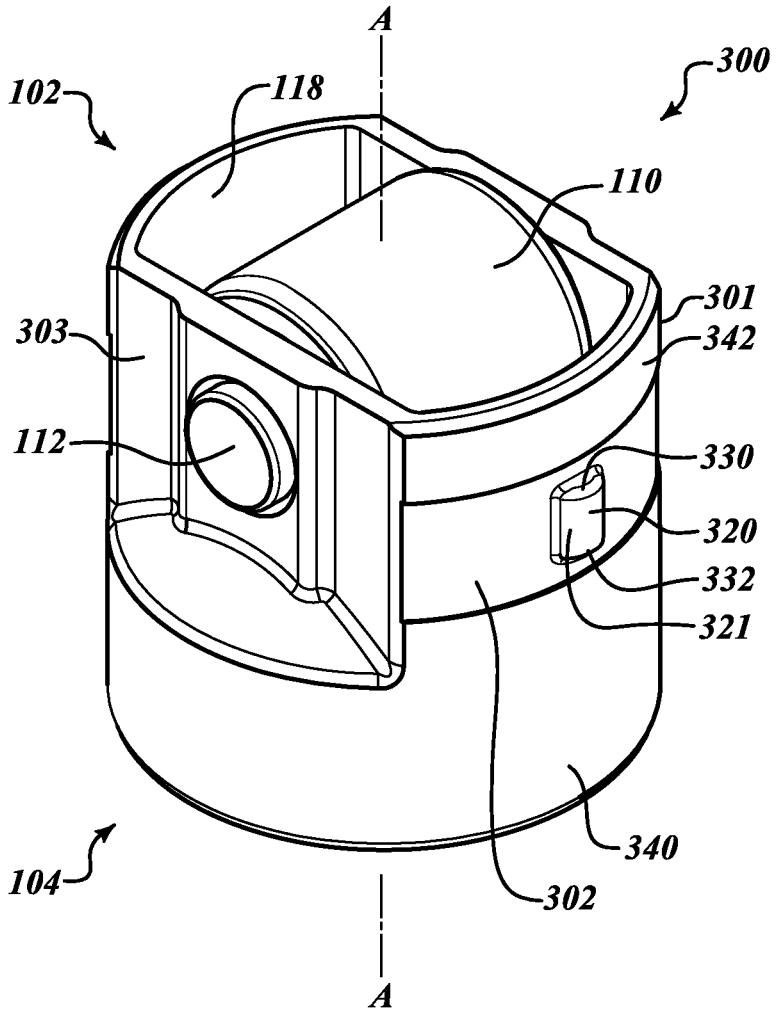
FIG. 12 illustrates a perspective view of a tappet 300 in accordance with another aspect of the present teachings.

With reference to FIG. 12, a body 301 can form a first cylindrical outer surface 302 located on an outer wall 303. In one aspect of the present teachings, the body 301 can be formed from a contiguous piece of forgeable material useable in a cold-forming process. An alignment portion 320 can have a cylindrical surface 321. End surfaces 330, 332 can join the cylindrical surface 321 of alignment portion 320 to the first cylindrical outer surface 302 of the outer wall 303. The cylindrical shape of alignment portion 320 can be centered on an axis parallel to axis A. The body 301 can also have a second 340 and third 342 cylindrical outer surface, each having a radius greater than first cylindrical outer surface 302. The alignment portion 320 of body 301 can protrude outwardly from first cylindrical outer surface 302, and can extend radially further than the second 340 and third 342 cylindrical outer surfaces.

Figure 13:
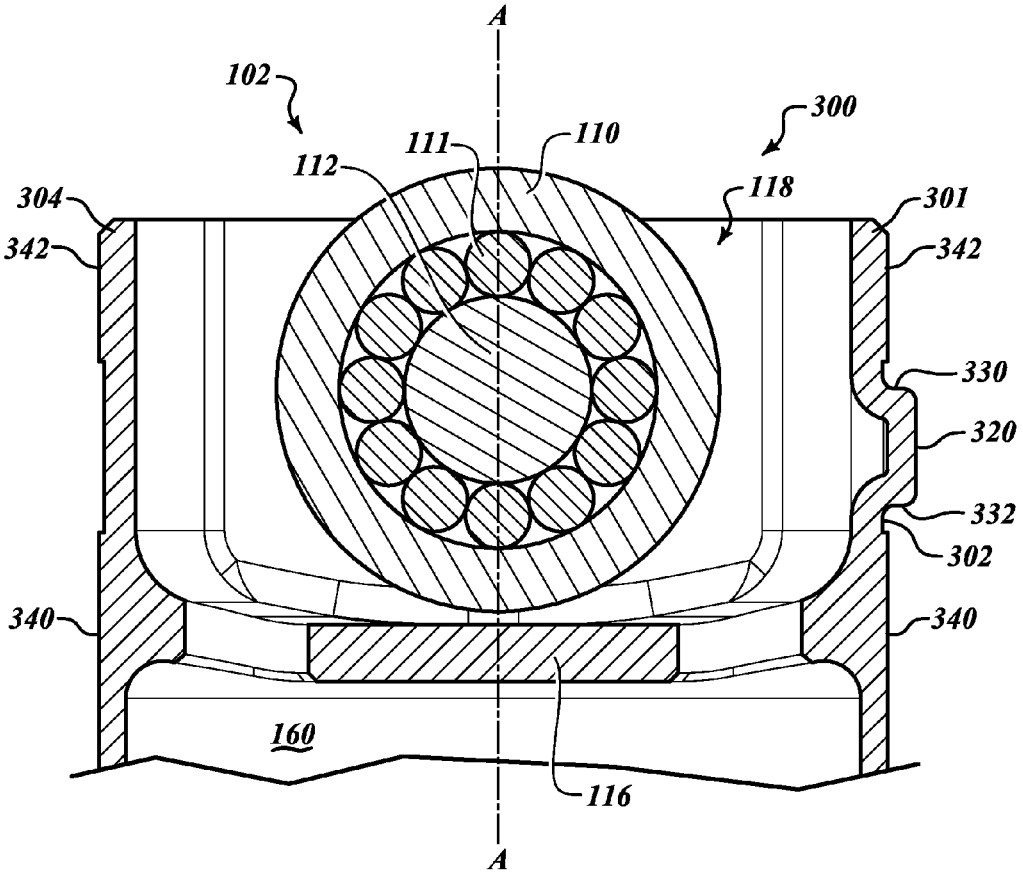
FIG. 13 illustrates a partial cross-sectional side view of the roller tappet 300 shown in FIG. 12.

With reference to FIG. 13, the alignment portion 320 can be formed as part of the body 301. Both end surfaces 330, 332 can extend from the first cylindrical outer surface 302 perpendicularly to the longitudinal axis of the tappet 300 at opposite ends of the alignment portion 320. The first end surface 330 can be disposed proximate to the cam contacting end 102 of tappet 300, while the second end surface 332 can be disposed distal to the cam contacting end 102. The transverse web 116 can separate the roller pocket 118 from cup-shaped portion 160. The alignment portion 320 is longitudinally offset from both the cam contacting end 102 and the transverse web 116, and is located between the cam contacting end 102 and transverse web 116.

Figure 14:
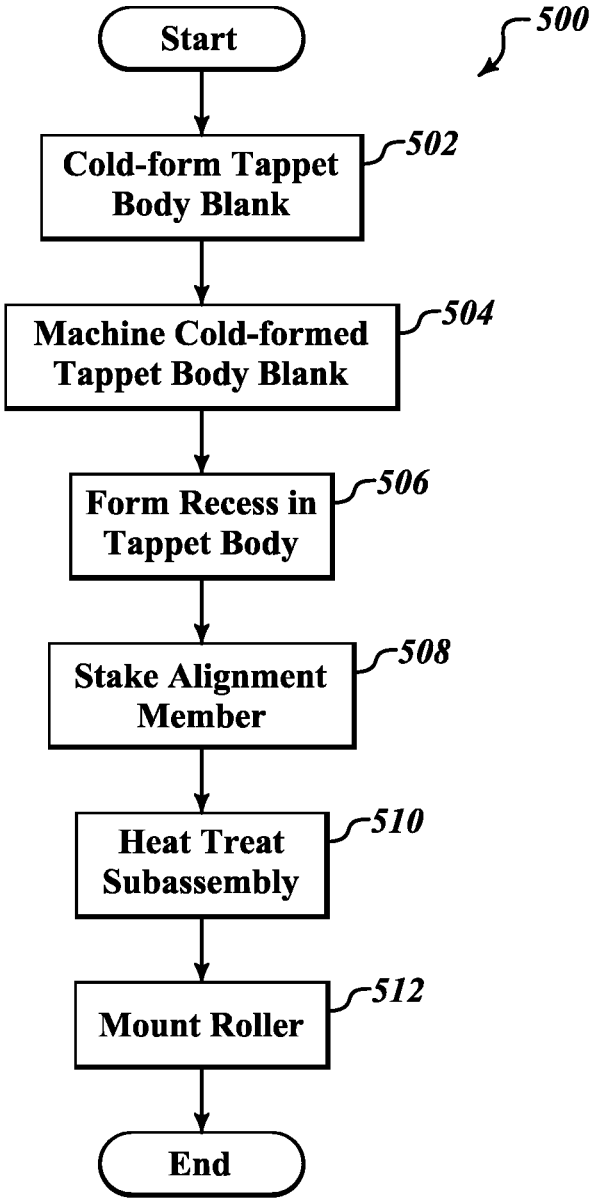
FIG. 14 illustrates a method 500 of manufacture of a roller tappet 100 in accordance with another aspect of the present teachings.

With reference to FIG. 14, a method of manufacture 500 of a roller tappet 100 according to the present teachings includes a step 502 of cold-forming a tappet body blank. The blank formed in step 502 is then machined in step 504. One aspect of the machining step 504 can be machining the ends 102, 104 of the blank to final dimensions, or axle holes 114. Additional features may be machined, including any aspects of the blank that have not been formed to final dimensions during forming step 502. In step 506, a recess 122 is formed within body 106. In one aspect of the present teachings, the recess 122 formed in step 506 may include the alignment member contacting surfaces 152, 154 and the intermediate surface 156.

With continued reference to FIG. 14, alignment member 120 can be inserted into the recess 122 and staked during step 508. Such staking can include deforming the body 106 adjacent alignment member securing surfaces 130, 132 at opposite longitudinal ends of the recess 122. Heat treating step 510 may follow the step 508 of staking the alignment member 120. Such heat treating can include heat treating a subassembly including the body 106 and the alignment member 120. In alternative aspects of the present teachings, the heat treating step 510 may be performed prior to the step 508 of staking the alignment member. In yet other aspects of the present teachings, deforming body 106 adjacent alignment member securing surfaces 130, 132 can be performed before insertion of the alignment member 120 into the recess 122, after which the alignment member 120 may be inserted into the recess 122 in a press-fit relationship. Roller 110 is mounted to bearing in step 512.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." As used herein, "about" will be understood by persons skilled in the art and will vary to some extent depending upon the context in which it is used.

While the present disclosure illustrates various aspects of the present teachings, and while these aspects have been described in some detail, it is not the intention of the applicant to restrict or in any way limit the scope of the claimed invention to such detail. Additional advantages and modifications will be apparent to those skilled in the art. Therefore, the teachings, in their broader aspects, is not limited to the specific details and illustrative examples shown and described. Accordingly, departures may be made from such details without departing from the spirit or scope of the applicant's claimed invention. Moreover, the foregoing aspects of the present teachings are illustrative, and no single feature or element is essential to all possible combinations that may be claimed in this or a later application.

The invention claimed is:

1. A tappet comprising: a contiguous body having an outer wall and a transverse web, the outer wall defining a recess in a cylindrically-shaped outer surface; a roller mounted to the body at a cam contacting end; and, an alignment member that extends outwardly from the cylindrically-shaped outer surface of the body, the alignment member having first and second ends, wherein a first alignment member securing surface and a second alignment member securing surface of the outer wall secure against the respective first and second ends of the alignment member and are operable to hold the alignment member in the recess, wherein the first alignment member securing surface and the second alignment member securing surface of the outer wall that secure against the alignment member are formed by indentations that form staked portions of the body.

2. The tappet of claim 1, wherein the alignment member is a cylindrical member and the recess is configured to receive the cylindrical member such that a majority of a volume of the cylindrical member is disposed radially inward from the cylindrically-shaped outer surface of the body.

3. The tappet of claim 1, further comprising a first contact surface and second contact surface that cooperate to at least partially define the recess, the first contact surface and the second contact surface each define a radius of curvature larger than a radius of curvature of the alignment member.

4. The tappet of claim 3, wherein the first contact surface and second contact surface are arranged to apply a normal contact force on the alignment member, and wherein no net dissociating forces are applied to the alignment member upon application of an external normal contact force in one of a majority of directions in which the external normal contact force is applicable to the alignment member.

5. The tappet of claim 3, wherein the first contact surface and second contact surface are arranged to apply a normal contact force on the alignment member oblique to a radial direction.

6. The tappet of claim 3, further comprising a cylindrically-shaped intermediate surface between the first and second contact surfaces, the intermediate surface having a radius of curvature equal to or smaller than the radius of curvature of the cylindrical member.

7. The tappet of claim 1, wherein the body includes a forgeable material.

8. The tappet of claim 1, wherein the first alignment member securing surface and the second alignment member securing surface of the outer wall that secure against the alignment member are adjacent staked portions of the body.

9. The tappet of claim 1, further comprising a concave curved surface at least partially surrounding the recess.

10. The tappet of claim 1, wherein the recess is disposed further from the transverse web relative to an opposite end of the body.

11. A tappet comprising: a contiguous body having an outer wall and a transverse web, the outer wall defining a recess in a cylindrically-shaped outer surface; a roller mounted to the body at a cam contacting end; a first means for maintaining alignment of a tappet; and, a second means for securing the first means to the contiguous body, the second means including first and second indentations forming staked portions into the outer wall of the contiguous body.

12. The tappet of claim 11, wherein the first means extends outwardly from the cylindrically shaped outer surface of the body.

13. The tappet of claim 11, wherein the second means defines a recess and wherein the first and second indentations include a first portion and a second portion respectively of the outer wall that secure against the first means and are operable to hold the first means in the recess.

14. The tappet of claim 11, wherein the first means has a cylindrical alignment member, and wherein the second means defines a recess in the cylindrically-shaped outer surface configured to receive the cylindrical alignment member such that a majority of a volume of the cylindrical alignment member is disposed radially inward from the cylindrically-shaped outer surface.

15. The tappet of claim 14, wherein the first means has a first contact surface and second contact surface that cooperate to at least partially define the recess, the first contact surface and the second contact surface each defining a radius of curvature larger than a radius of curvature of the cylindrical alignment member.

16. The tappet of claim 15, wherein the first means has a cylindrically-shaped intermediate surface between the first and second contact surfaces, the intermediate surface having a radius of curvature equal to or smaller than the radius of curvature of the cylindrical alignment member.

17. The tappet of claim 11, wherein the second means defines adjacent staked portions of the body.

18. The tappet of claim 11, wherein the body includes a forgeable material.

19. A method of manufacturing a tappet, comprising: forming a roller tappet body blank having a transverse web and outer wall; machining at least a portion of the tappet body blank to final dimensions; deforming the outer wall to form a recess; inserting an alignment member into the recess, the alignment member including a cylindrical member having first and second ends; staking the outer wall by forming indentations in the outer wall adjacent the alignment member and toward the respective first and second ends of the alignment member.

20. The method of claim 19, wherein the staking step includes deforming the outer wall at longitudinal ends of the recess.

21. The method of claim 20, further comprising heat-treating the body and alignment member.

22. The method of claim 19, wherein the staking step occurs prior to the inserting step.

23. The method of claim 19, wherein the staking step occurs subsequent to the inserting step.

24. The method of claim 19, wherein the inserting step includes inserting an alignment member including a through hardened steel into the recess.

* * * * *